US006231284B1

(12) United States Patent
Kordel

(10) Patent No.: US 6,231,284 B1
(45) Date of Patent: May 15, 2001

(54) FREIGHT CONTAINER UTILIZATION AND TO A PALLET THEREFOR

(75) Inventor: Wojtek Kordel, Northwich (GB)

(73) Assignee: Coil-Tainer Limited, Malvern, PA (US)

( * ) Notice: Subject to any disclaimer, the term of this patent is extended or adjusted under 35 U.S.C. 154(b) by 0 days.

(21) Appl. No.: 09/264,731

(22) Filed: Mar. 9, 1999

(30) Foreign Application Priority Data

Mar. 12, 1998 (GB) ..... 9805246

(51) Int. Cl.[7] ..... B60P 7/12; B61D 3/16

(52) U.S. Cl. ..... 410/49; 410/47; 410/50; 108/55.3

(58) Field of Search ..... 410/47, 49, 50, 410/32, 42; 108/55.1, 55.3; 220/1.5, 23.88; 206/386, 397, 408, 446, 597; 414/399, 400, 809

(56) References Cited

U.S. PATENT DOCUMENTS 3,070,043 * 12/1962 Decker .
3,392,682 * 7/1968 Francis .
3,476,260 * 11/1969 Jay .
3,753,407 * 8/1973 Tilseth .
4,221,536 * 9/1980 McFee .
4,506,796 * 3/1985 Thompson .
5,050,756 * 9/1991 Tielker et al. .
5,054,987 * 10/1991 Thornton .
5,374,151 * 12/1994 Matthews .
5,413,054 * 5/1995 Collins .
5,515,977 * 5/1996 Lambert .
5,769,376 * 6/1998 Bostic et al. .
5,931,435 * 8/1999 Hoadley et al. .

FOREIGN PATENT DOCUMENTS

3514975 A1 * 10/1986 (DE) .
43 28 823 3/1995 (DE) .
0 596 755 5/1994 (EP) .
96 09232 3/1996 (WO) .

* cited by examiner

*Primary Examiner*—D. Glenn Dayoan
*Assistant Examiner*—Scott Carpenter
(74) *Attorney, Agent, or Firm*—Seidel Gonda Lavorgna & Monaco, PC

(57) ABSTRACT

The present invention relates to the transport of cargo in containers, especially cargo which would usually be transported as bulk cargo, for example coils of sheet steel. The problem of securely loading cargo within a container is overcome by the present invention by utilizing a plurality of pallets which in combination occupy the floor space of a container and using the required number of pallets, whether loaded or not, to provide pallet load location and restraint. For the anticipated bulk cargo comprising loads of up to 10,000 kg, and between 10,000 and 25,000 kg, two pallet sizes are envisaged a longer size being twice as long as a shorter size. The preferred pallets have a width equal of the width of the container. For a container capable of carrying 30,000 kg, three load configurations are contemplated, namely: four of the shorter pallets with each loaded at say 7,000 kg, two of the large pallets with each loaded at say 13,000 kg, or one large pallet and two small pallets with only the large pallet loaded at say 25,000 kg. The unloaded pallets serve as localized restraint for the loaded pallet.

Figure 1:
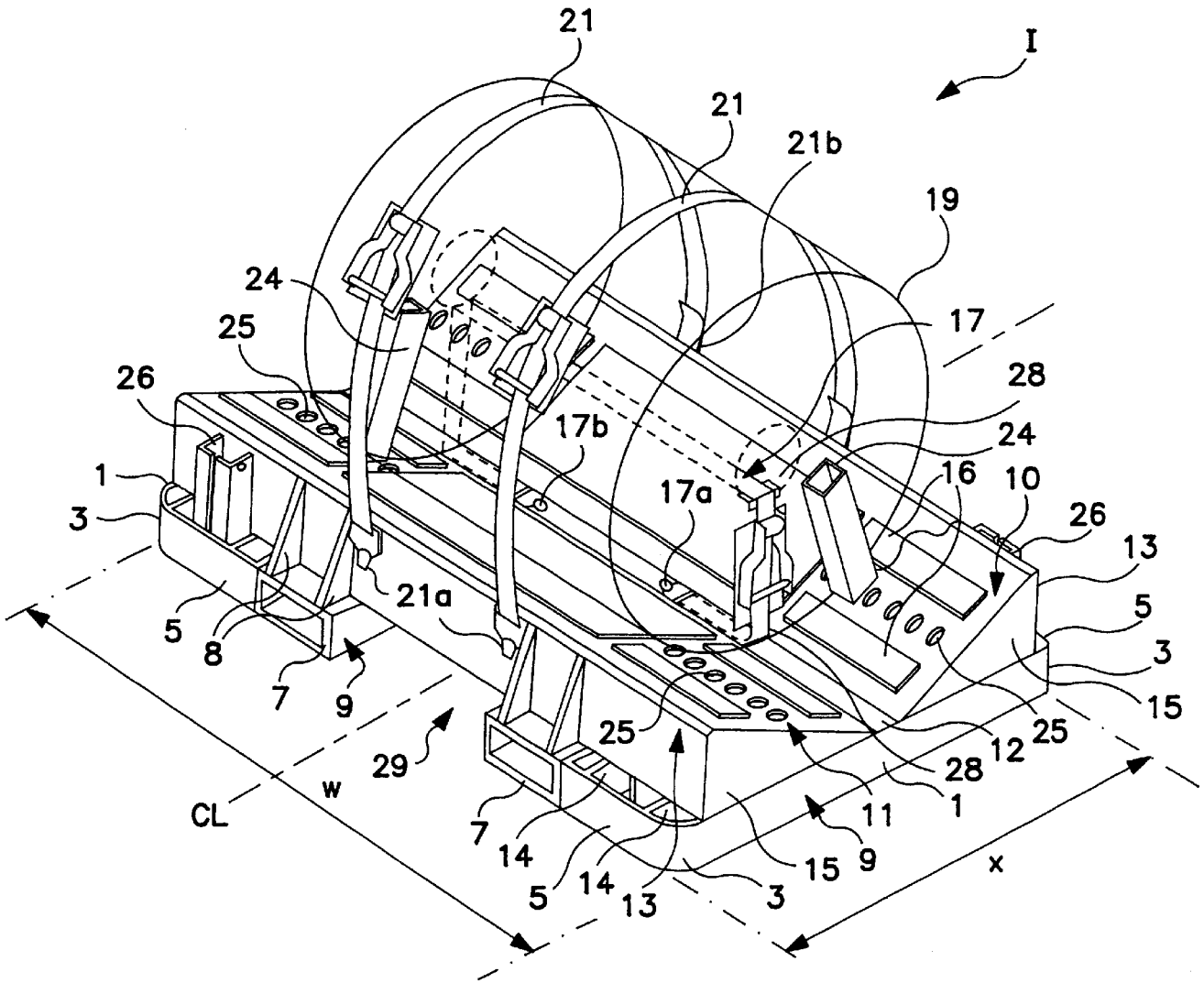

The invention further proposes a pallet for use in the method comprising a pair of laterally spaced longitudinally extending ground contacting surfaces which serve to distribute load to the outer one third of the width thereof. The center one third is clear. The pallet further comprises a load receiving cradle which provides longitudinal restraint between oppositely inclined surfaces. Adjustable lateral restraint means is provided including repositionable legs upstanding from the load receiving cradle or bars which are pivotally and slidably adustably mounted with respect to the pallet for lateral adjustment.

19 Claims, 10 Drawing Sheets

150
152
154
156
158
160
162
164
166
170
1'
5'
7
8
10
11
12
13
14
16'
A
B
C
X

FREIGHT CONTAINER UTILIZATION AND TO A PALLET THEREFOR

FIELD OF THE INVENTION

The present invention relates to the transportation of objects by container, a modular container palletization system, and to a pallet for use in transporting goods by container.

The invention has particular application to the transportation of metal coils, especially coils of sheet material, especially steel coils, or other high value products such as paper aluminum coils, or organic or other high value coated steel coils, but without limitation to same. It provides a means by which goods which are usually transported as bulk freight can be containerized.

BACKGROUND OF THE INVENTION

Historically the transportation of goods by road, rail or water involved loading individual items and was labor intensive. Cranes provided assistance for handling some loads and the advent of the fork lift truck led to the introduction of palletized loads which avoided handling of individual items when transferring between different types of transport at freight terminals. Palletized loads still offered limitations in relation to the speed of handling and especially in relation to their stacking capacity. This has led to development and widespread adoption of containers. Various sizes have now become standardized 20' (6 m) long containers are the most common. The width has become standardized at 2438 mm. Containers can be loaded at source and are easily transferred between different types of transport e.g. road, rail or ship. Forklift trucks can be used to load a container with palletized loads. Pallets are approximately 48"×40" (1200–1000 mm) square. Ten pallet places can be accommodated in a standard container. Large ocean going vessels have been designed for handling the containers which can be stacked one on top of the other perhaps as many as seven high. Containers have the advantage of offering protection to the contents within.

There is a constant flow of containers around the globe to meet the requirements for the supply of raw materials and products. To maximise container utilization it is desirable to be able to fill a container whenever it is moved from one location to another, but it has been calculated that 20% of containers are transported empty on re-positioning runs.

Some products are still transported as bulk loads. One of the products which is still most frequently transported as a bulk load on board ship is steel coil. These coils range in weight between 7,000 kg and 25,000 kg. The coils are stored in dockside warehouses which have a large capacity say of the order of 20,000,000 to 50,000,000 kg. The capacity has to be large enough to cover the required demand for steel coils between shipments. If a more regular supply chain could be established the need for these warehouses could be reduced.

The transportation of cargoes such as steel coils as bulk cargo exposes the coils to potential damage be it mechanical damage or that resulting from exposure to sea water. Often the base material is provided with a high value coating such as an organic paint finish which needs to be protected against damage. For bulk cargo this has led to the encapsulation of the coils. Because containers can be sealed against water ingress, the need for additional protective packaging could be avoided if the coils were transported in containers and it would be particularly advantageous if it was possible to use containers which would otherwise be empty.

There are frequent container shipments and the ability to utilize containers for shipment of cargoes such as of steel coils would provide a possible solution to the above mentioned problems. However, there is a problem with the utilization of the existing construction of containers for the shipment of small high weight loads because, whilst the containers are designed to carry up to 30,000 kg, the weight has to be evenly distributed over the floor. A typical design of pallet comprises 3 or 4 longitudinal wooden bearers interconnected by a number of longitudinally spaced laterally extending planks providing a load surface for the pallet. Placing a coil of steel, say a 7,000 kg coil of steel, on a pallet of this design, say with its axis vertical for stability reasons, would impart localized loading on the container floor which would exceed its design capacity when supplemented by the dynamic loads imposed during transportation at sea.

In theory a container could carry 3×7,000 kg coils, 2×13,000 kg coils or one 25,000 kg coil. In addition to the above mentioned weight distribution problem, there is a further problem of how to load such heavy weights into a container. Various designs of fork lift truck have the capacity to lift palletized loads of 7,000 kg, 13,000 and even 25,000 kg, but they can only deposit the load into the rear of the container. Open frame containers have been developed which permit side loading, or loading by way of a crane, but there are relatively few of these containers in circulation.

In order to improve container utilization a system needs to be developed which facilitates the transportation of such large weights.

Another problem which has detracted from the utilization of containers for transportation of such large weights is the need to ensure secure stowage of cargoes such as steel coils within the container. Such large weights could easily burst their way through the container sides and the traditional approach to securing loads is to brace the load within the container, typically using wood. The construction of wooden bracing is time consuming and its subsequent disposal and/or recycling further adds to the cost. The EEC Directive on Packaging and Packaging Waste 94/62 EEC will have far reaching effects on the costs of producing and transporting of goods which requires considerable packaging. The above factors have conspired to render the bulk transportation of steel coils the most appropriate means of transportation of such items until now.

SUMMARY OF THE INVENTION

The present invention aims to provide a solution.

Accordingly, a first aspect of the invention proposes a modular container palletization system comprising a plurality of pallets each adapted to carry a load and wherein a number of the pallets are used in combination to provide palletted load location and restraint within the container with a least one pallet carrying a load.

By using the pallets in combination whether loaded or not, the need for additional bracing materials is avoided. Preferably, each pallet is dimensioned to have a width corresponding to the width of the container. The length of each pallet is a fraction of the length of the container. More preferably two or more different sizes of pallets are utilized at least as concerns the length of the pallets. More preferably still the different lengths are related. It is preferred to employ two different lengths of pallets with the longer of the two lengths being a multiple of the shorter length. In the preferred embodiment four of the shorter pallets occupy the full length of a 6m container. Preferably a longer pallet is twice as long as a shorter pallet. Such a combination allows four shorter pallets to be used in one configuration. In another configuration, two longer pallets are used, or in a third configuration one longer pallet and two shorter pallets are used. By using pallets in this configuration, the load can be distributed along the length of the container.

Another aspect of the invention provides a pallet which is generally rectangular and comprising oppositely disposed side members serving as abutments to limit lateral movement within the container, and a load supporting cradle to receive the load and distribute it to ground engaging support members disposed spaced apart to opposite sides of a longitudinal centre line of the pallet, and comprising means for locating the load longitudinally and laterally.

In a preferred embodiment the load supporting cradle provides one of the longitudinal and lateral locating means and further means is provided to provide the other of the lateral and longitudinal locating means. In an alternative embodiment the cradle provides both the lateral and longitudinal locating means.

More particularly the load supporting cradle comprises a pair of longitudinally spaced laterally extending elongate members. More preferably still the load supporting cradle comprises means which is configured to contact the load. Where the load is a coil said means contacts an arcuate part of the load. Said means may comprise a part cylindrical contact surface or a pair of part cylindrical contact surfaces. Conveniently these may be covered by a resilient material which acts to cushion the load as well as to distribute the forces into the load supporting cradle. In a preferred embodiment, the means which is contacted by the load comprises a pair of oppositely inclined surfaces defining a V-shape to receive the load nestling therebetween. The inclined surfaces are backed up by one or more gussets which are preferably orientated in the longitudinal direction and abut the ground engaging support members to distribute the load thereto. Preferably the means for locating and holding the load laterally is laterally adjustable to cater for different widths of load. Said means may comprise laterally movably adjustable bar means. In one embodiment said means are conveniently releasably relocatable in aperturing therefor. Said means may be mounted in alternative orientations. In a first orientation said means functions as a lateral abutment for the load. In a second orientation, the upper end provides a peg by which two pallets can be located with respect to one another, one on top of the other. Two pegs are provided for each pallet.

In an alternative embodiment a pair of bar means are provided and each comprise an elongate element which extends across the cradle and is movably adjustably in the lateral direction. Means is provided for locating the bar means with respect to the pallet. Preferably the bar means is pivotably and slidably connectable with the cradle. A rack having a plurality of notches facilitates locating the bar means in a selected lateral position.

Adjustable strapping may be further provided to resist lateral telescoping of the load.

Conveniently the pallet has aperturing permitting entry from one or both ends to receive the forks of a fork lift truck. More particularly the pallet has a recess open to the underside thereof to permit use with spaced elongate load carrying tracks employed with mating trolleys for movement of the pallets within a container.

DETAILED DESCRIPTION OF THE DRAWINGS

The different sizes of pallet are constructed similarly.

Another aspect of the invention provides a method of locating a load within a container utilizing a plurality of pallets whose width and length in combination equals the internal length and width of the container, the method comprising determining the maximum number of loaded pallets which can be accommodated in the container having regard to its weight carrying capacity, determining the proportion of container floor area which is occupied by the maximum number of loaded pallets which can be accommodated in the container and selecting the number of unloaded pallets, if any, which are required to occupy the unoccupied space, and positioning the loaded pallets and any unloaded pallets into the container in a sequence which will distribute the load most evenly along the length and width of the container.

DETAILED DESCRIPTION OF THE DRAWINGS

Figure 2:
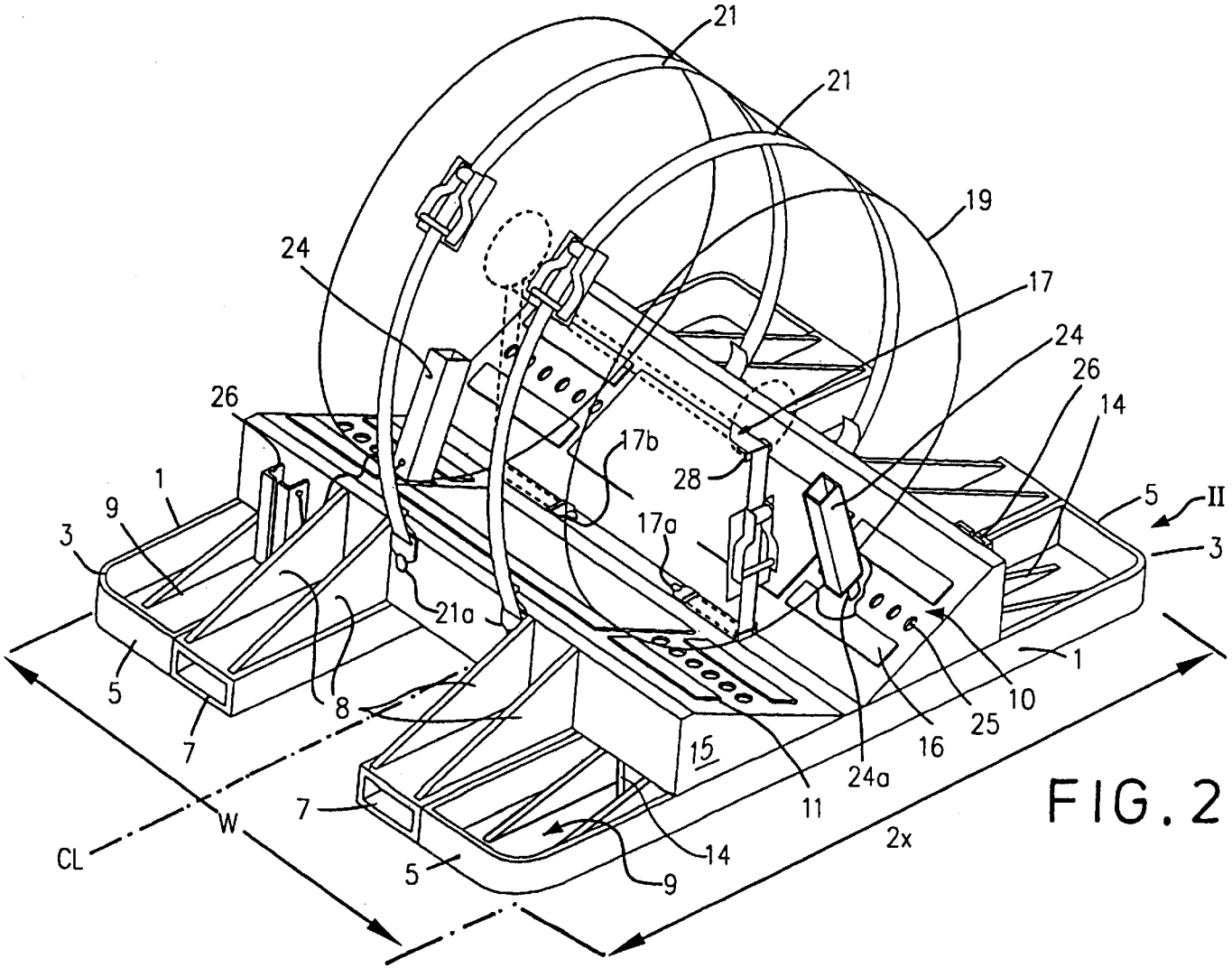
Figure 3:
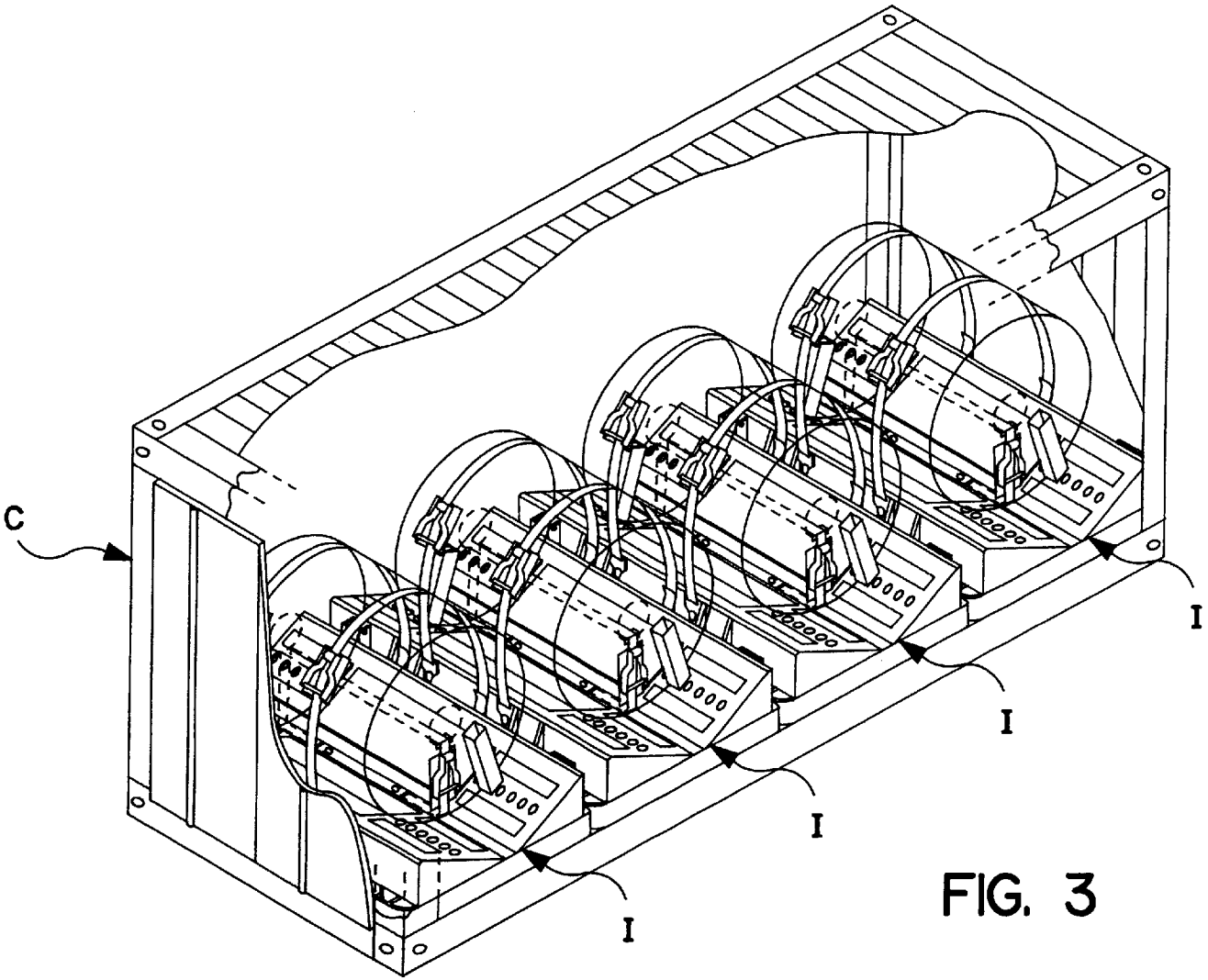
Figure 5:
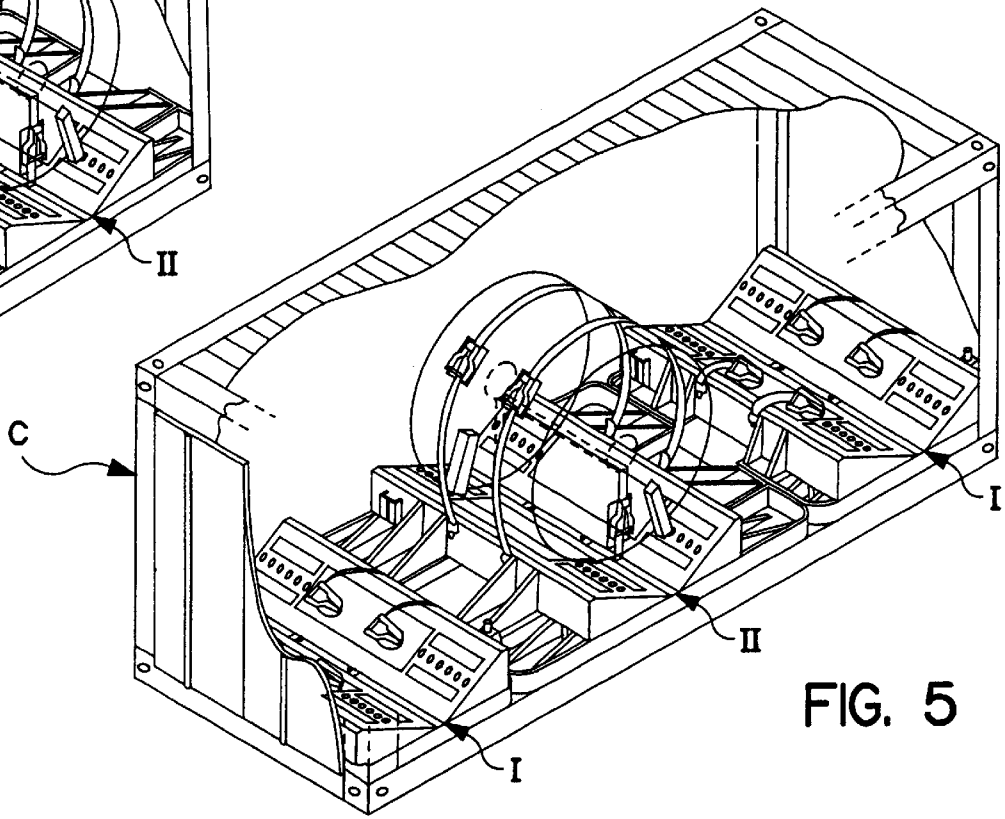
Figure 4:
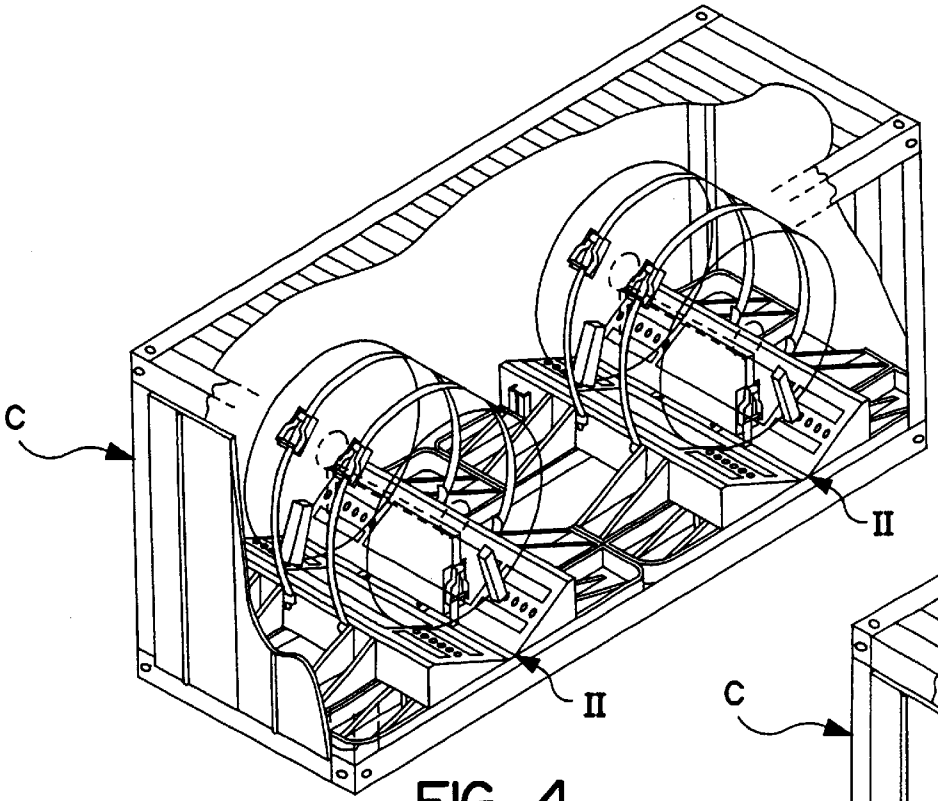
Figure 6:
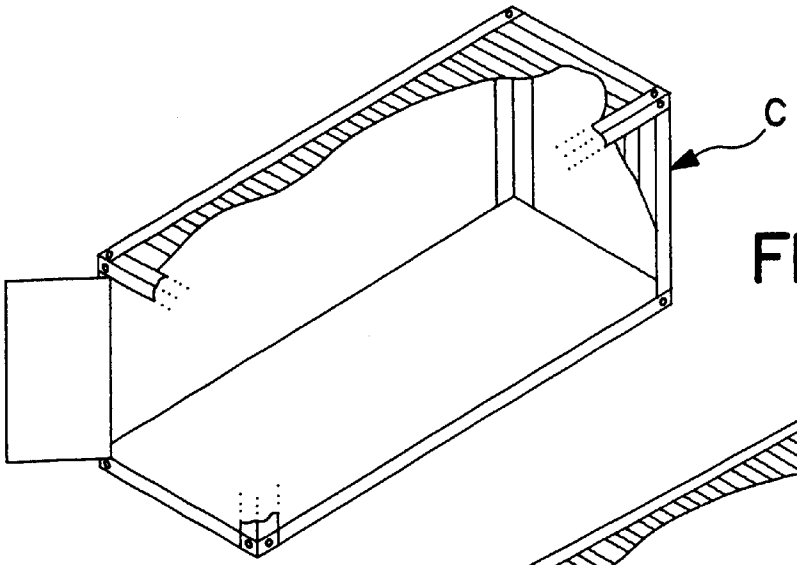
Figure 18:
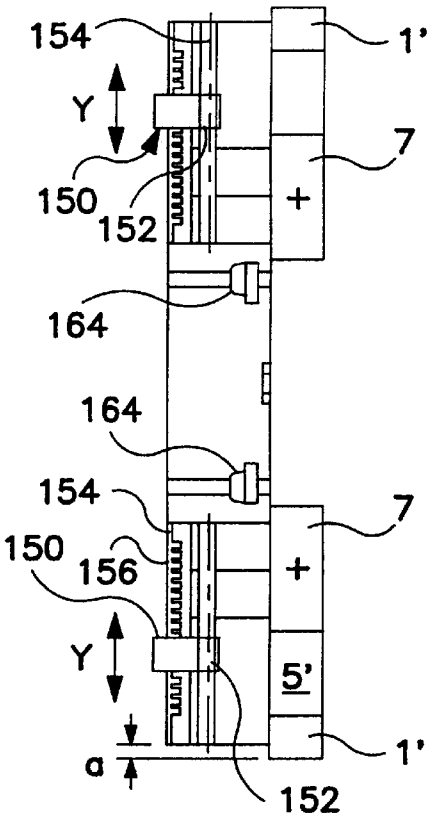
Figure 14:
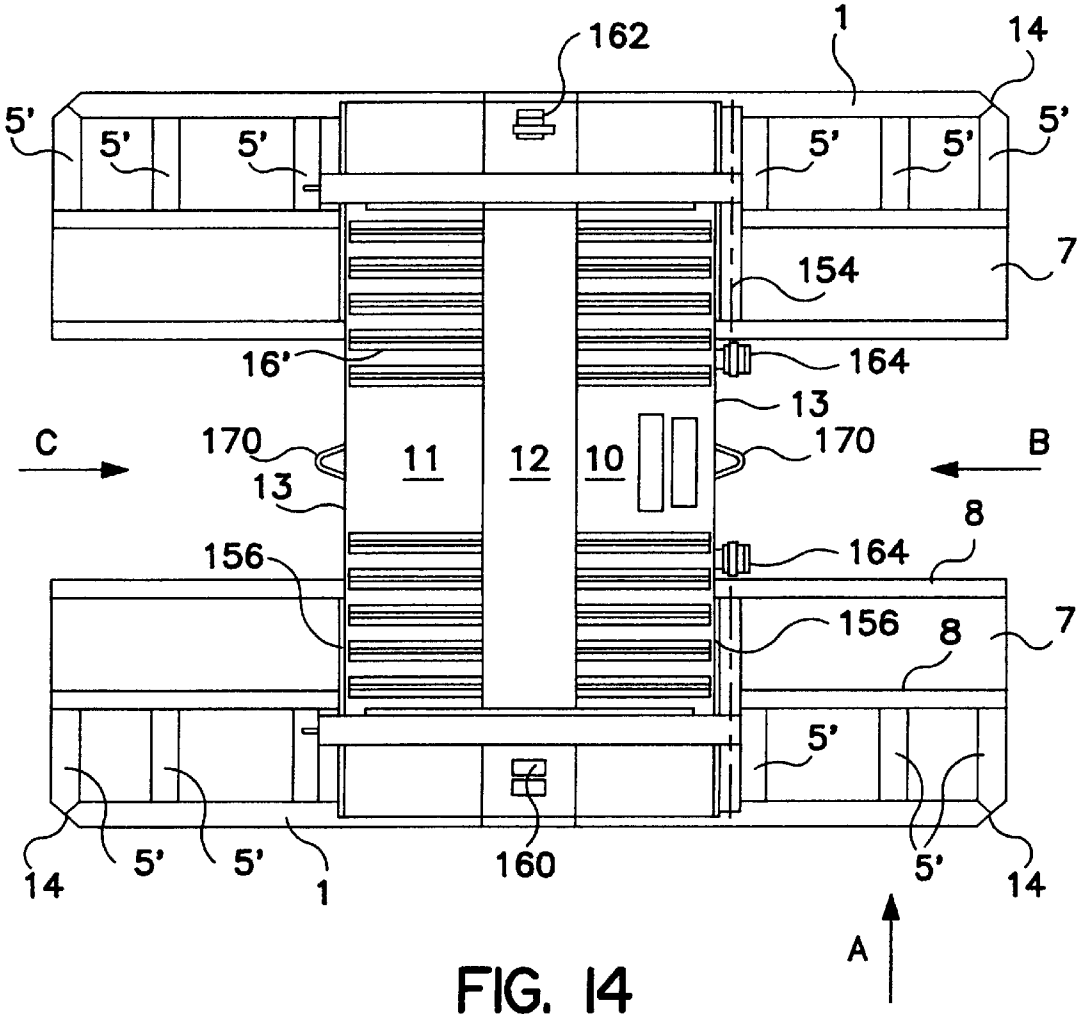
Figures 15, 16, 17, 19:
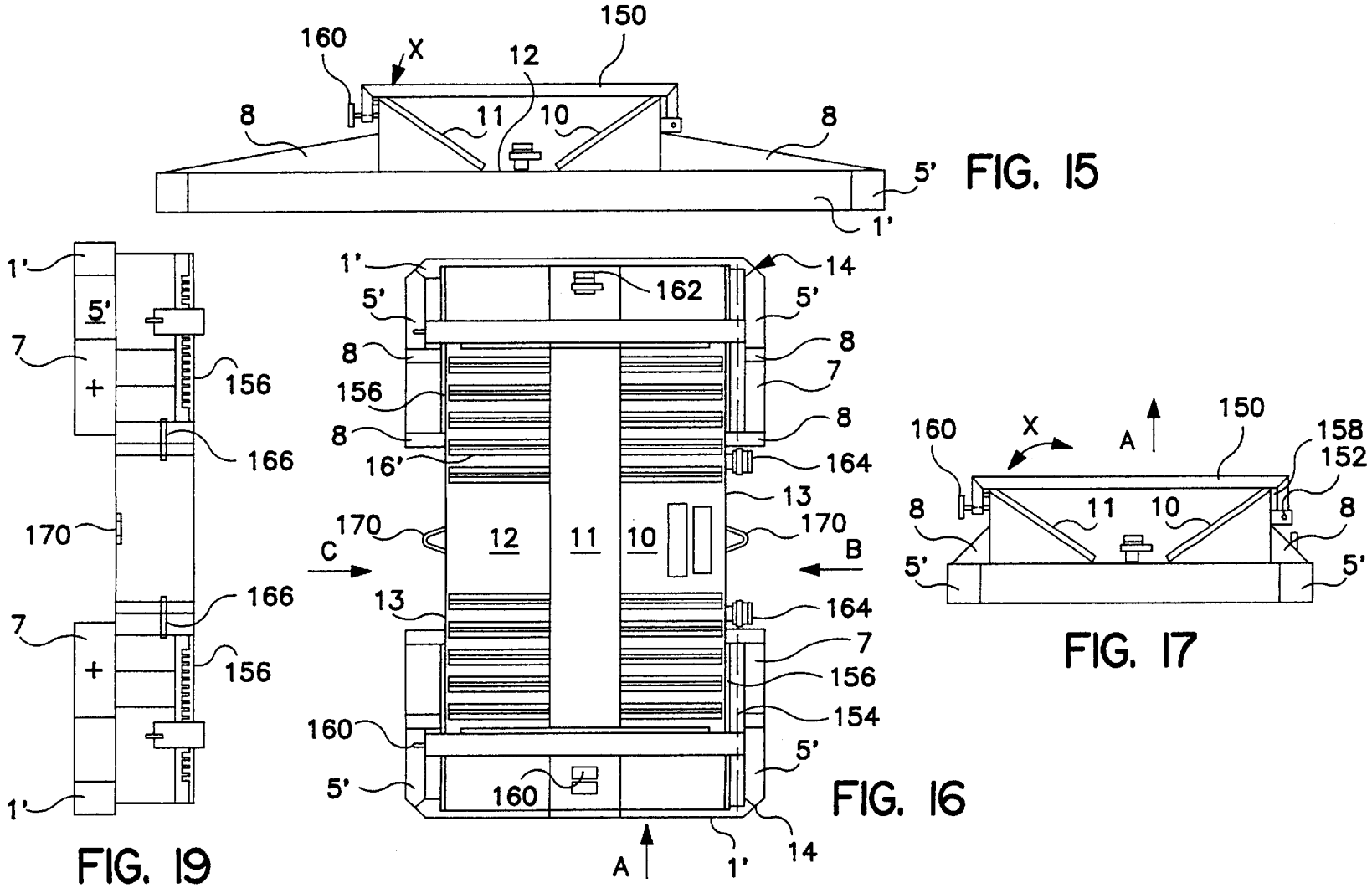

The present invention will now be described further by way of example only with reference to the accompanying drawings in which:

FIGS. 1 & 2 are perspective views of two sizes of pallet,

FIGS. 3, 4 & 5 are cut away perspective views illustrating how the two different sizes of pallets can be used in different combinations, FIGS. 6 to 13 illustrate a method of loading a container, FIGS. 14 and 16 are plan views of two sizes of pallet according to an alternative embodiment, FIG. 15 is a side view looking in the direction of arrow A of FIG. 14, FIG. 17 is a side view looking in the direction of arrow A of FIG. 16, FIG. 18 is an end view looking in the direction of arrow B of FIG. 14 or 16, and FIG. 19 is an end view looking in the direction of arrow C of FIG. 14 or FIG. 16.

FIG. 1 illustrates a loading handling pallet I according to a first embodiment of the invention. This is generally rectangular and has a width W which corresponds substantially to the internal width of a standard freight container (i.e. min. 2330 mm) with maneuvering clearance. The length of the pallet is shown by the dimension X. The dimension X is equal to one quarter of the length of a standard 6m enclosed ISO container. The longitudinal centre line is shown at CL. Opposite lateral edges of the pallet are formed by an upstanding member 1 to provide lateral location of the pallet within the container. Member 1 is curved at its opposite ends to form the corners 3 and has inwardly extending limbs 5, each of which is secured to the edge of a box section channel member 7. Two of said box section channel members 7 are provided running in the longitudinal direction and spaced to opposite sides of the centre line of the pallet. The hollow box sections allow entry of a pair of spaced forks of a fork lift truck for lifting the pallet. The area comprising the underside of the elongate box section 7 and laterally outwardly thereof to the boundaries of the limbs 5 and lateral side members 1 provides a ground contacting support surface 9 and is infilled. The centre one third of the pallet is devoid of any ground support surface.

The pallet has a load supporting cradle which in the illustrated embodiment comprises two longitudinally spaced oppositely inclined spaced apart laterally extending support surfaces 10, 11 connected by a base 12 which engages with the elongate box section elements 7. The longitudinally spaced extremities of the inclined surfaces 10, 11 are connected to respective laterally extending elongate load distribution members 13. These distribute load into the ground contacting support surfaces, divided by webs 8 and gussets 15 beneath the inclined surface and at the lateral ends which serve to reinforce same and distribute load into the ground contacting support surface 9 and aid weight distribution thereto. Longitudinally extending webs 14 also serve to distribute load onto the ground contacting support surfaces 9. As illustrated in outline at 19 the item to be carried is usually a cylindrical element and in the preferred application is a coil of steel sheet. The inclined surfaces will accommodate coils of different diameters. Surface 10 is covered with a sheet or discrete strips 16 of resilient material, such as high density plastics, to avoid marking of the coil and/or to act as an anticorrosion layer and to further aid weight distribution. Two securing straps shown at 21 are secured at opposite ends 21*a*, 21*b* to the cradle and arranged to pass around the circumference of the coil 19. A ratchet adjustment system is provided. In the illustrated embodiment two laterally spaced securing straps are illustrated but this is not to be viewed as limiting.

In the illustrated embodiment lateral restraint of the coil is provided by lateral support legs 24. These are received releasably in a selected one of a plurality of apertures 25 in the inclined surface. The leg has a round cylindrical peg 24*a* to one end to for this purpose whereby the legs 24 can be positioned in the desired lateral position. Brackets 26 provide an alternative reception location for the legs. The legs are received in this alternative location in an inverted orientation so that the peg is uppermost. The peg is designed to be received in an aperture in the underside of another pallet when correctly positioned on top of the pallet I to locate the two pallets with respect to one another. There is a space 29 beneath the underside of the laterally extending load distribution members 13 and between the ground contacting supporting surfaces of the pallet. The purpose of this will become apparent from the following description.

A further adjustable load restraining strap is illustrated at 17. It is threaded through the hollow core of a coil and has its ends 17*a*, 17*b* secured to the pallet at a position within the width of the coil. It is pulled taut by a ratchet adjustment system as is well known in the art and not described further hereinafter. Where the strap changes direction it passes over curved L-shaped brackets 28 which distribute the load. This strapping also serves to prevent telescoping of the coil beyond the effect of the latest restraint legs 21.

Referring now to FIG. 2, this shows an alternative embodiment of load carrying pallet II which has all the same characteristics as the pallet described with reference to FIG. 1 and corresponding reference numerals have been employed. The only significant difference is that the pallet is dimensioned differently in relation to the length. The width corresponds to that of the previous pallet but the pallet II is twice as long as the pallet I. The first embodiment is designed to carry loads of up to 10,000 kg; the second embodiment is designed to carry loads up to 25,000 kg and more specifically standard coil weights of 10,000 kg and 25,000 kg. It will be seen that the load from the coil is distributed into the ground engaging support surfaces 9 from the load receiving cradle by the above described load distribution elements. Webs 8 are increased in length to resist and distribute longitudinal forces. The pallets are preferably made of steel, although other materials may be suitable. The use of the two embodiments of pallet as illustrated in FIGS. 1 and 2 are described further hereinafter.

FIG. 3 shows a standard 6 m ISO container C in which are received four of the pallets I illustrated in FIG. 1. It will be seen that they are a close fit within the container and it will be apparent that the load supporting surface is positioned to distribute load into the outer one third of the floor leaving the central third of the floor clear of any load. This enables the load carrying capacity of the floor of the container to be best utilized. FIG. 4 shows the same container C accommodating two of the pallets II of FIG. 2, each of which is carrying a coil which can be up to 13,000 kg in weight. The two pallets occupy the floor area of the container and as such locate and restrain one another and the load thereon. Finally, FIG. 5 shows the same ISO container accommodating one pallet II of the FIG. 2 design and two pallets I of the FIG. 1 design. In this combination the pallets I of the FIG. 1 design are used to locate the other pallet II centrally within the container permitting the centre container to carry a coil of 25,000 kg weight. In an alternative configuration the centre pallet might contain a 13,000 kg weight and the two outer pallets 7,000 kg weights.

Referring now to FIGS. 14 to 19, there is illustrated two sizes of pallet constructed according to an alternative embodiment. As with the previous embodiments the two sizes of pallet have the same width, which width is dimensioned to be a close fit in the width of a typical shipping container, typically of the order of 2294 mm overall.

The larger pallet of FIG. 14 is substantially twice as long as the smaller pallet, typically of the order of 2930 mm versus 1470 mm, thus permitting the same combinations of the two sizes to be fitted in a shipping container as previously described.

Parts corresponding to those of the previously described embodiment utilize the same reference numerals and are not described in further detail. The pallets retain the aforementioned pair of box section channel members 7. However, the opposite lateral edges of the pallet are formed by a smaller section hollow box section 1', which is secured to the channel member 7 by a plurality of similar section hollow box section limbs 5'. Using this construction it has been found that adequate weight distribution can be achieved, whilst making considerable savings in the weight of the pallet. An open frame construction is utilized, making it possible to dispense with the previous infilling for the ground contacting support surface and with the webs 14.

The load supporting cradle is substantially the same as that described previously and utilizes the two longitudinally spaced oppositely inclined spaced apart laterally extending support surfaces 10, 11 connected by a base 12. Laterally extending elongate load distribution member 13 connect with the pallet foot. The comers of the pallet foot are chamfered as shown at 14. The lateral margin of the cradle is reduced in width compared with the width of the pallet foot—see a. The inclined surfaces of the cradle are provided with a plurality of strips 16' which conveniently comprise extruded rubber or synthetic equivalents, and which provide some cushioning and good frictional contact with the load.

An alternative means of restraining the load in the lateral direction is employed and is described further hereinafter. It utilizes a bar 150 which extends across the width of the cradle and one end carries a journal 152 by which the bar is received pivotably and laterally slidably adjustably on a tube 154 which allows it to pivot as shown by arrow X and slide in the direction represented by arrow Y. The opposite sides of the cradle carry a notched rack 156. The bar 150 carries respective lugs 158 to cooperate with a respective notch of the rack 156 when the bar is in the lowered (illustrated, position). A T-bar locating element 160 (typically spring loaded) is provided to the other end of the bar to locate it in the lowered position by engaging underneath the notched bar 156 to that end of the rack 150. By means of this mechanism the two bars 150 can be positioned in close proximity to the lateral sides of the load when placed on the cradle.

Strapping means is provided to further locate the coil to the pallet and comprising a first strapping element which is intended to pass through a central aperture in the coil between a lashing point 160 and an anchor point comprising a winch element 162. One or two strips may be applied over the coil from winch element 164 and passing around anchor 166.

Steel loops 170 are provided to receive pulling hooks for maneuvering the pallet on skates.

Figure 7:
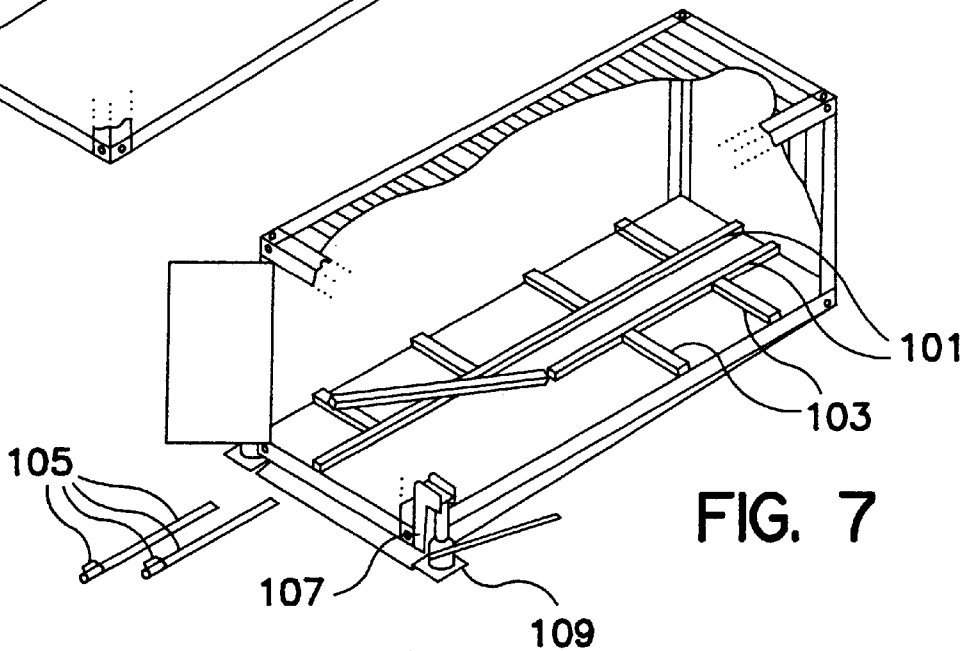
Figure 8:
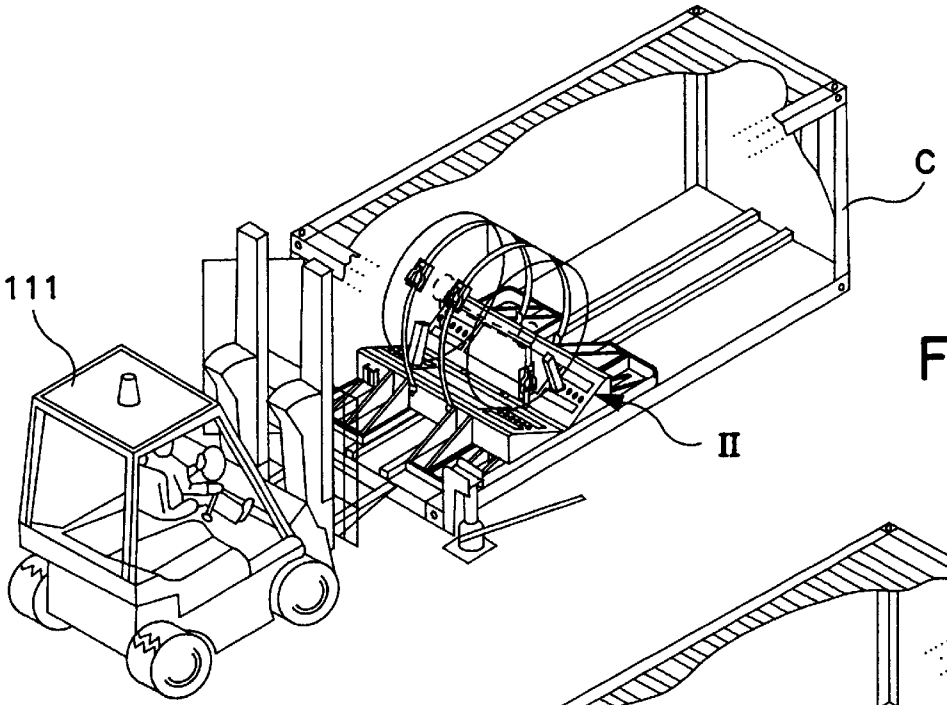
Figure 9:
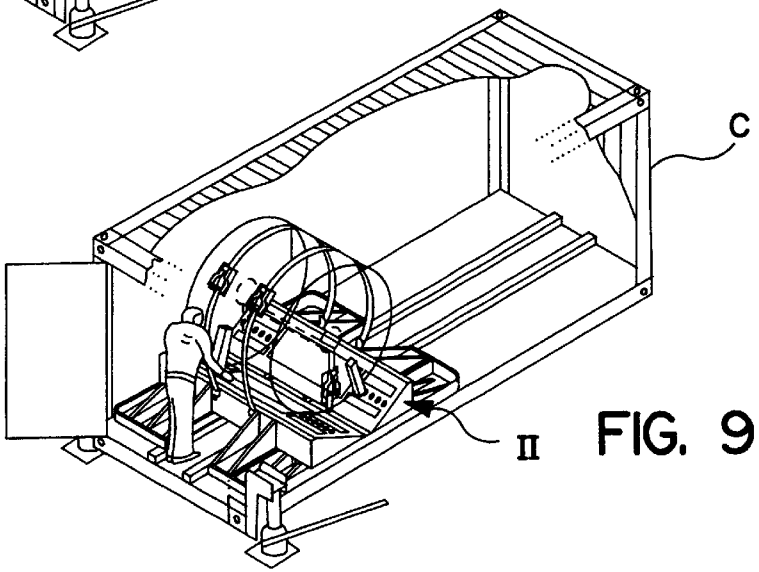
Figures 10, 11:
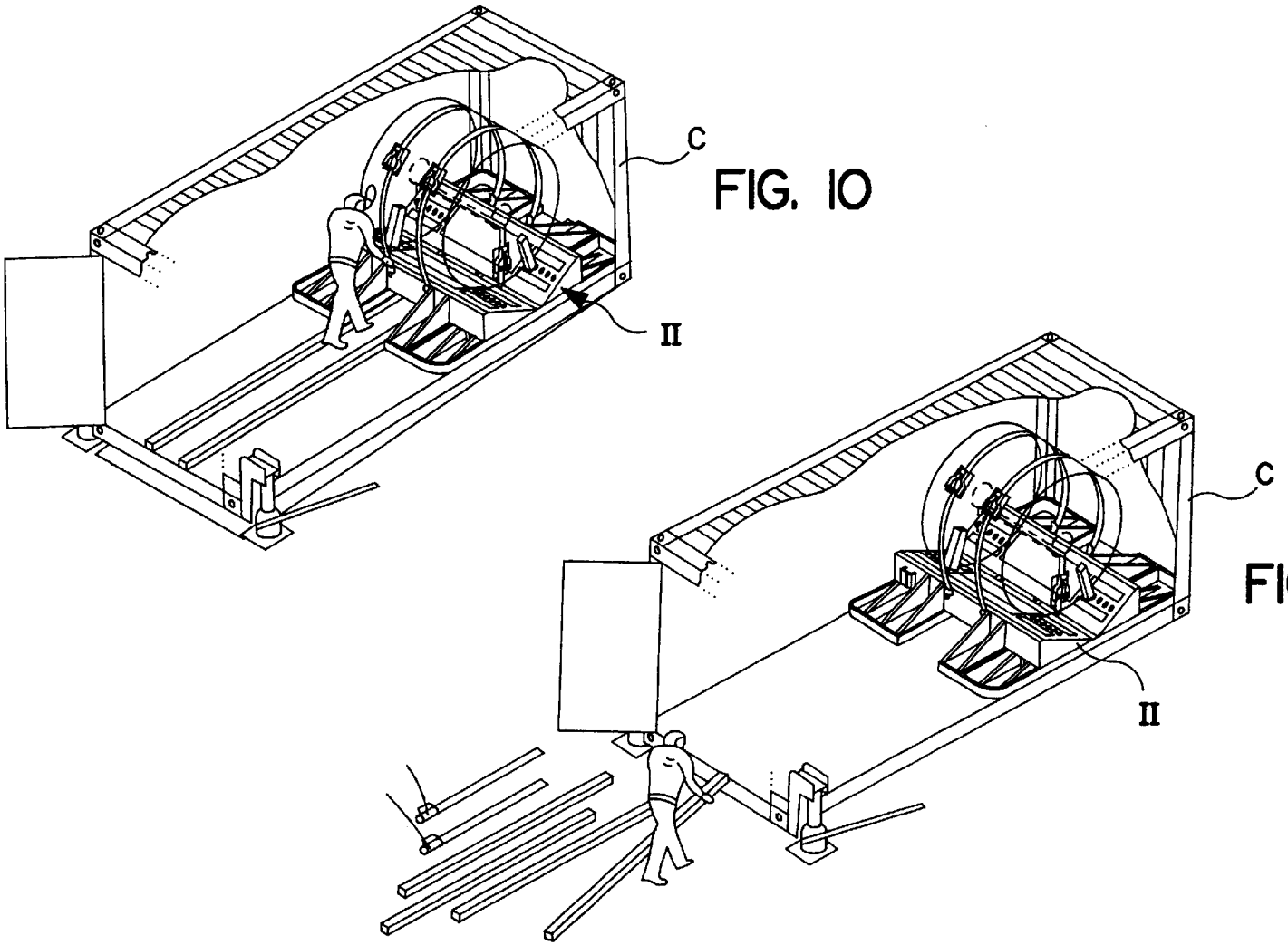
Figure 12:
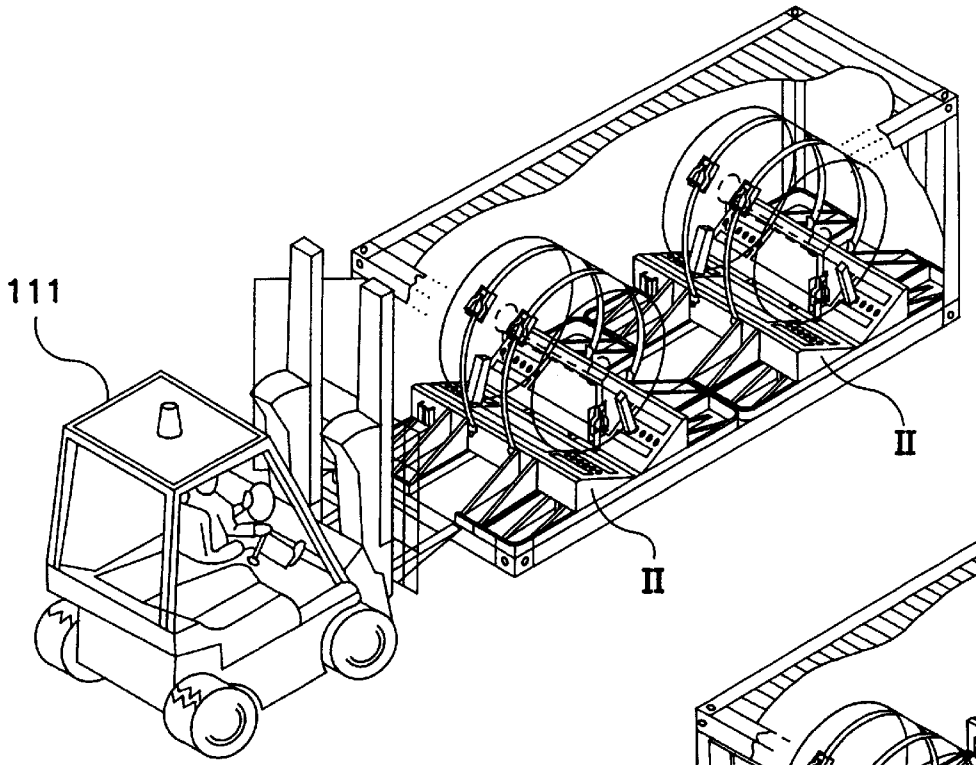
Figure 13:
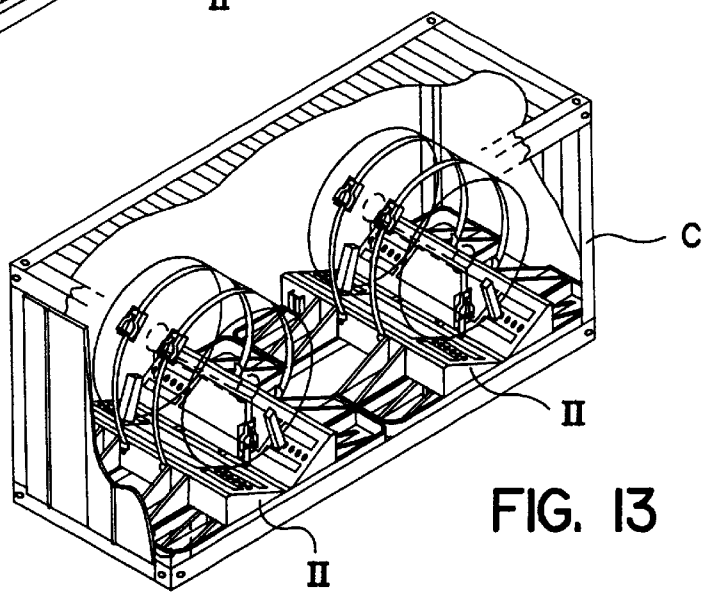

Reference is now made to FIGS. 6 through 13 which illustrate the steps in one method by which a container C can be loaded with the above-described pallets. For the purpose of illustration two pallets II corresponding to those of FIG. 2 design carrying coils of 13,000 kg are being loaded. A standard container is shown at C in FIG. 6. It comprises a standard 6 m ISO end loading dry freight container. FIG. 7 shows the positioning of elongate load handling track elements 101 within the container and braced by laterally extending brace elements 103. Load handling trolleys for use in each of the tracks is shown at 105. Such a portable track load handling system is marketed under the trade mark JOLODA. The tracks are at a spacing which positions them between the elongate box section members 7. In this position the load handling trolleys 105 will engage with the underside of the member 13 so that the pallet can be raized for movement. In view of the weight to be loaded into the container it is desirable to incline the floor of the container by 3° to 5°. This can be achieved by fitting angle brackets 107 to the front comer posts and using a hydraulic jack 109 to elevate the open end of the container or by the use of blocks. Thereafter a pallet of the type II as illustrated in FIG. 2 and on which a steel coil has been previously located and secured is maneuvered by a fork lift truck 111 and deposited in the open end of the container as illustrated in FIGS. 8 and 9. Once in this position the load can be elevated using the hydraulic skates 107 and the load moved to the forward end of the container as shown in FIG. 10. In this position the skates are lowered to allow them to be removed and the portable track removed. The open end of the container can also be lowered to the ground. A second loaded pallet II is loaded into the container using a fork lift truck as shown at FIG. 12, whereafter the fully loaded container with loaded pallets/coils restrained is ready for sea shipment or otherwise. Unloading follows the reverse of the above procedure.

It will be appreciated from FIGS. 3, 4 and 5 that alternative load configurations can be readily adopted using the two different sizes of load pallet. The pallets are configured to be stacked one on top of the other to facilitate return in a container so that it is possible to return several sets of pallets in one container.

What is claimed is:

1. A modular container palletization system comprising a plurality of pallets selected from at least two different sizes of pallet and each of which is adapted to carry a load and wherein a number of pallets are used in combination to provide palleted load location and restraint within a container with the pallets occupying the full width and length of the container and with at least one pallet carrying a load and wherein the pallet is generally rectangular, extends the full width of the container and comprises: oppositely disposed side members serving as abutments which in use limit lateral movement within a container; ground engaging support members disposed spaced apart to opposite sides of a longitudinal center line of the pallet: and means for locating a load, when present, longitudinally and laterally with respect to the pallet.

2. A modular palletization system as claimed in claim 1 in which each pallet has a length which is a fraction of the length of the container.

3. A modular palletization system as claimed in claim 1 in which two pallets of equal length occupy the length of a 6 m container.

4. A modular palletization system as claimed in claim 1 in which the at least two different sizes of pallet comprise two different lengths of pallet and in which a longer of the two lengths of pallet is twice as long as a shorter of the two lengths of pallet.

5. A modular palletization system as claimed in claim 4 in which two of the shorter pallets and one of the longer pallets occupy the length of a 6 m container.

6. A modular palletization system as claimed in claim 1 in which four pallets of equal length occupy the length of a 6 m container.

7. A modular palletization system as claimed in claim 1 in which the container is an enclosed end loading container.

8. A modular container palletization system as claimed in claim 1, in which each pallet comprises a load supporting cradle to receive the load and distribute it to the ground engaging support members.

9. a modular container palletization system as claimed in claim 8 in which the load supporting cradle comprises a pair of oppositely inclined straight or curved surfaces extending laterally to receive a load nestling therebetween.

10. A modular container palletization system as claimed in claim 1 in which the means for locating the load laterally comprises two legs which are laterally adjustable to facilitate positioning in close proximity to lateral sides of the load.

11. A modular container palletization system as claimed in claim 10 and further comprising a plurality of laterally spaced location apertures and wherein the legs are each received in a selected one of the apertures according to the desired spacing.

12. A modular container palletization system as claimed in claim 10 in which one end of each leg is configured as a peg to be received in one of said apertures.

13. A modular container palletization system as claimed in claim 12 and further comprising an alternative reception location for each leg and wherein each leg is received in a said aperture with the peg uppermost.

14. A modular container palletization system as claimed in claim 13 in which the legs serve as a means of supporting and locating one pallet on top of another.

15. A modular container palletization system as claimed in claim 1 in which the means for locating the load laterally comprises two bars which are pivotably and slidably mounted with respect to the pallet and are laterally adjustable and locatable with respect to the pallet.

16. A modular container palletization system claimed in claim 1 further comprising load restraining means comprising at least one adjustable strapping member.

17. A modular container palletization system as claimed in claim 1, wherein said ground engaging support members comprise two laterally spaced longitudinally extending members of hollow box section and further ground engaging support means in the form of a framework disposed laterally outwardly of each hollow box section.

18. A method of locating a load within a container utilising a plurality of pallets, wherein each of the plurality of pallets extending for the full width of the container being selected from at least two different sizes of pallet, each of which is adapted to carry a load, wherein the width and length of the plurality of pallets in combination equals the internal length and width of the container, the method comprising determining the maximum number of loaded pallets which can be accommodated in the container having regard to its weight carrying capacity, determining the proportion of container floor area which is occupied by the maximum number of loaded pallets which can be accommodated in the container and selecting the number of unloaded pallets, if any, which are required to occupy the unoccupied space, and positioning the loaded pallets and any unloaded pallets into the container in a sequence which will distribute the load most evenly along the length and width of the container.

19. A method as claimed in claim 18 in which the pallets are selected from pallets having equal width but two different lengths, and in which a longer of the two lengths of pallet is twice as long as a shorter of the two lengths of pallet.

* * * * *